US005182138A

United States Patent [19]

Matsuzawa et al.

[11] Patent Number: 5,182,138

[45] Date of Patent: Jan. 26, 1993

[54] LUMINESCENT SHEET FOR STAMP AND A METHOD FOR THE PRODUCTION THEREOF

[75] Inventors: Shigeji Matsuzawa, Itami; Eiji Yuasa, Takatsuki; Junichiro Tanaka, Nishinomiya; Teruo Nakamura, Kobe, all of Japan

[73] Assignee: Kanzaki Paper Manufacturing Co., Ltd., Tokyo, Japan

[21] Appl. No.: 618,944

[22] Filed: Nov. 27, 1990

[30] Foreign Application Priority Data

Nov. 27, 1989 [JP] Japan ..... 1-308706

[51] Int. Cl.[5] ..... B05D 1/12; B02C 23/02

[52] U.S. Cl. ..... 427/157; 428/690; 428/917; 428/402; 427/67; 427/180; 241/172; 241/21

[58] Field of Search ..... 428/690, 219, 402, 409, 428/917; 427/180, 201, 172, 21; 252/301.6 R; 241/16, 26, 27, 172, 21

[56] References Cited

U.S. PATENT DOCUMENTS 4,692,266 9/1987 Costa et al. ..... 252/301.17

*Primary Examiner*—Ellis P. Robinson
*Assistant Examiner*—Charles R. Nold
*Attorney, Agent, or Firm*—Wenderoth, Lind & Ponack

[57] ABSTRACT

A luminescent sheet for stamps comprising a subtrate and a luminescent layer formed on the surface of said substrate, characterized in that said luminescent layer contains fine particles of an inorganic fluorescent pigment, said fine particles being prepared by providing a dispersion containing particles having a mean specific surface area $Sw_2$ of said inorganic fluorescent pigment in water, and subjecting said dispersion to wet-grinding to obtain an aqueous dispersion containing fine particles having a mean specific surface area $Sw_1$ of said inorganic fluorescent pigment, and said fine particles satisfying the equation: $2.0 \geqq Sw_1/Sw_2 \geqq 1.05$.

10 Claims, No Drawings

LUMINESCENT SHEET FOR STAMP AND A METHOD FOR THE PRODUCTION THEREOF

FIELD OF THE INVENTION

The present invention relates to an improved luminescent sheet for stamps. More particularly, the present invention relates to an improved luminescent sheet containing an inorganic fluorescent pigment for stamps and a method for producing said sheet.

BACKGROUND OF THE INVENTION

A number of beautiful stamps issued in various countries of the world are known. Those stamps have peculiarities of the countries which issued them and are varied in design, size, constituent, and the like.

In recent years, the number of pieces of mail has been increasing and thus, the number of pieces of mail to be processed daily at post offices, etc. has been increasing. In order to facilitate work to process the mail, mechanization of this work has been developed, particularly at the post offices. For instance, there has been used a detecting system for distinguishing such mail depending upon the stamps put on them, whereby facilitating the work to process them at the post offices. As such system, there are known a system of distinguishing mail by detecting colors printed in the stamps put on the mail, a system of distinguishing mail by detecting emission from fluorescent pigments such as inorganic fluorescent pigments contained in the stamps put on the mail, and the like, which facilitate the processing work for the mail at the post offices such as those for distinguishing the mail whether or not they have proper stamps thereon. Of these systems, the system of processing the mail with the utilization of emission from the stamps put thereon has been mostly developed.

Those stamps containing fluorescent pigments which are commonly referred to as luminescent stamps are generally prepared by a method in which a mark, an image or the like, is printed on the surface of a sheet for stamps with a printing ink incorporated with an inorganic fluorescent pigment, using a gravure printing machine. Upon printing said printing ink on said sheet in this case, a doctoring blade is usually used to remove an excessive portion of the printing ink disposed on the gravure roll of the gravure printing machine. In this process there often occur problems that since the printing ink contains the inorganic fluorescent pigment in an insufficiently dispersed state, minute scratches including minute claw-like lines, etc. are often caused on the gravure roll and those minute scratches are transferred onto the sheet to provide undesirable prints which are defective not only in appearance but also in printed state.

In order to eliminate the above problems, there has been made a proposal that instead of incorporating the aforesaid inorganic pigment into the ink, said inorganic pigment is incorporated into the coating layer of a sheet for stamps. Such sheet for stamps is prepared by applying a coating composition containing an inorganic fluorescent pigment onto a base sheet (namely, substrate) by a coater to form said coating layer on the surface of the base sheet. However, as well as in the above case using the inorganic fluorescent pigment-containing ink, there often occur problems also in this case that grit of the inorganic fluorescent pigment provides negative influences to cause minute scratches. In addition to this, the inorganic fluorescent pigment is harder than other coating pigments such as calcium carbonate, and the like, and because of this, it causes damage to a cutting blade upon cutting a stamp product into stamp pieces or upon die-cutting a stamp product applied with tack treatment into stamp pieces, respectively by said cutting blade.

SUMMARY OF THE INVENTION

It is a principle object of the present invention to eliminate the foregoing problems encountered in the known luminescent stamp sheets and to provide an improved luminescent sheet for stamps which is free of those problems.

Other objects of the present invention are to provide an improved luminescent sheet for stamps comprising a substrate and a coating layer containing fine particles of an inorganic fluorescent pigment (the fine particles will be hereinafter referred to as "inorganic fluorescent pigment fine particles") in a uniformly dispersed state being formed on the surface of said substrate, which provides a desirable print of a mark, image, or the like for stamps excelling in appearance upon gravure printing without causing the foregoing problems of minute scratches including minute claw-like lines, minute streakes, etc. which are found in the prior art.

A further object of the present invention is to provide the aforesaid improved luminescent sheet for stamps which can be desirably cut or die-cut into stamp pieces without damaging a cutting blade.

Still further object of the present invention is to provide a method for producing the above improved luminescent sheet for stamps.

DETAILED DESCRIPTION OF THE INVENTION

The luminescent sheet for stamps of the present invention which attains the above objects comprises a substrate and a coating layer containing specific inorganic fluorescent pigment fine particles being formed on said substrate. The luminescent sheet for stamps according to the present invention is characterized by having an improved coating layer containing said specific inorganic fluorescent pigment fine particles which are uniformly dispersed therein. Because of this, the luminescent sheet for stamps provides a print of a mark, image, or the like for stamps excelling in appearance and printed state with a printing ink by gravure printing without causing such minute scratches as found in the known luminescent sheet for stamps, and it can be cut or die-cut by a cutting blade without damaging said cutting blade to afford desirable stamps.

The stamps thus obtained can be desirably used to put on mail and those mail having said stamps thereon can be effectively distinguished in the foregoing mail distinguishing system since the stamps exhibit sufficient emission to be quickly detected by a detector of said system. Thus, the daily work of distinguishing mail at the post offices can be facilitated.

The foregoing specific inorganic fluorescent pigment fine particles to be contained in the coating layer of the luminescent sheet for stamps according to the present invention are of a mean specific surface area ($cm^2/g$) which satisfies the following equation (1): $2.0 \geqq Sw_1/Sw_2 \geqq 1.05$ . . . (1), with $Sw_1$ being a mean specific surface area ($cm^2/g$) of the inorganic fluorescent fine particles obtained by subjecting the starting inorganic fluorescent particles having a mean specific surface area $Sw_2$ ($cm^2/g$) to wet-grinding in the way as will be hereunder described.

The inorganic fluorescent pigment fine particles having a mean specific surface area satisfying the equation (1) are prepared by providing an aqueous dispersion containing inorganic fluorescent pigment particles (that is, the starting inorganic fluorescent particle) having a mean specific surface area $Sw_2$ in a predetermined amount (this aqueous dispersion will be hereinafter referred to as "the starting aqueous dispersion) and subjecting the starting aqueous dispersion to wet-grinding, wherein the starting inorganic fluorescent pigment particles in said aqueous dispersion are ground as desired, to thereby obtain inorganic fluorescent pigment fine particles having a desired mean specific surface which satisfies the foregoing equation (1) in the form of an aqueous dispersion. In a preferred embodiment, the coating layer of the luminescent sheet for stamps of the present invention is comprised of the foregoing specific inorganic fluorescent pigment fine particles, other pigment fine particles and an adhesive. The coating layer is formed by providing a proper coating composition containing at least said three kinds of materials, applying a predetermined amount of the coating composition onto the surface of a substrate to form a liquid coating, which is followed by drying.

The present invention has been accomplished based on the following findings which were obtained by the present inventors through experiments. That is, conventional inorganic fluorescent pigment particles to be used in the known luminescent stamps are of about 2 μm in a mean particle size. The present inventors found that a dipersion comprising said pigment particles in water is apt to cause a secondary agglomeration in which the pigment particles become associated with each other to form grit of 10 to 50 μm in size. In order to dissociate such grit caused as a result of the secondary agglomeration, the present inventors tried to disperse the secondary agglomerate containing such grit in water by a high—power agitator such as Kady—Mill (produced by Rikagaku Kogyo Co., Ltd, Japan), Cowles Dissolver (Morehouse Industries, Inc. U.S.A.), etc. However, there was not caused distinguishable dissociation of the secondary agglomerate. Thus, the present inventors recognized that it is difficult to resolve the foregoing problems caused by the grit of the inorganic fluorescent pigment contained in the coating layer of the luminescent sheet for stamps which are found in the prior art unless there is realized a desirable coating dispersion in which fine particles of the inorganic fluorescent pigment are uniformly dispersed without causing any secondary agglomerate for the formation of the coating layer. The present inventors then tried to use a wet-grinding machine, which is represented by commercially available Attritor (produced by Mitsui—Miike Seisakusho Co., Ltd.), Sand Mill, or Dyno—Mill (produced by Willy A. Bachofen Machinnenfabrik, Switzerland), in which particles of a material to be ground are mechanically agitated together with beads to repeatedly cause attrition and collision not only between said particles and said beads but also among said particles to finely grind said particles, in order to obtain said desirable dispersion. In fact, the present inventors treated the starting aqueous dispersion containing particles of an inorganic fluorescent pigment in the above wet-grinding machine to obtain an aqueous dispersion containing the foregoing inorganic fluorescent pigment fine particles having a mean specific surface area satisfying the foregoing equation (1) uniformly dispersed therein. They prepared a coating composition by using the aqueous dispersion thus obtained, and applied the coating composition thus obtained onto a substrate to obtain a luminescent sheet for stamps. The resultant sheet was subjected to gravure printing and the resultant sheet was cut into pieces by a cutting blade to obtain stamp products. At the stage of the gravure printing, the state of prints provided on the surface of the coat layer formed on the substrate was evaluated. As a result, it was found that there are provided desirable prints accompanied by neither any missing dots nor any minute scratches, or the like which are found in the prior art. Further, at the stage of cutting the gravure-printed sheet by the cutting blade, there were observed not only the cut-edge of the sheet but also the state of the cutting blade, i.e., whether said blade has been damaged. As a result, it was found that the sheet had been cut in a desirable state without damaging the cutting blade. Further, the stamps obtained were evaluated to determine whether they exhibited sufficient emission to be efficiently distinguished one from the other by a detector. As a result, it was found that they can be efficiently distinguished one from the other.

The present invention has been accomplished based on the above findings. As above described, the luminescent sheet for stamps according to the present invention is characterized by having a coating layer formed on a substrate by using a specific aqueous dispersion containing fine particles of an inorganic fluorescent pigment having a mean specific surface area satisfying the foregoing equation (1).

In order to form said coating layer by using said aqueous dispersion in the present invention, a coating composition incorporated with a predetermined amount of said aqueous dispersion is provided, and a predetermined amount of the coating composition is applied onto the surface of a substrate to form a liquid coating comprising said coating composition thereon, followed by drying.

As above described, the above aqueous dispersion to be used for the formation of the coating layer of the luminescent sheet for stamps according to the present invention is required to contain inorganic fluorescent pigment fine particles having a mean specific surface area ($cm^2/g$) satisfying the foregoing equation (1), that is, $2.0 \geqq Sw_1/Sw_2 \geqq 1.05$, with $Sw_1$ being the mean specific surface area of the inorganic fluorescent pigment fine particles obtained through the wet-grinding treatment and $Sw_2$ being the mean specific surface area of the starting inorganic fluorescent pigment particles prior to the wet-grinding treatment.

When the inorganic fluorescent fine particles to be contained in the aqueous dispersion are of a mean specific surface area which is less than 1.05 for the ratio of $Sw_1/Sw_2$, dissociation of grit caused by secondary agglomeration among the particles of the inorganic fluorescent pigment is not sufficiently performed and because of this, the grit causing the foregoing problems is unavoidably incorporated into the coating layer. Thus, the object of the present invention cannot be attained by using such aqueous dispersion containing the aforesaid inorganic fluorescent pigment fine particles.

When the inorganic fluorescent fine particles to be contained in the aqueous dispersion are of a mean specific surface exceeding 2.0 for the ratio of $Sw_1/Sw_2$, the resulting coating layer becomes such that it exhibits an undesirably reduced intensity of emission and therefore, the luminescent sheet for stamps according to the present invention cannot be obtained by using such inorganic fluorescent fine particles.

The aqueous dispersion containing the foregoing specific inorganic fluorescent fine particles to be used for the formation of the coating layer of the luminescent sheet for stamps according to the present invention is prepared by providing a dispersion containing a predetermined amount of particles of an inorganic fluorescent pigment in water as the starting aqueous dispersion and introducing the dispersion into the foregoing wet-grinding machine. The particles are mechanically agitated together with beads to repeatedly cause attrition and collision not only between said particles and said beads but also among said particles, whereby finely grinding said particles to obtain an aqueous dispersion containing inorganic fluorescent pigment fine particles having a mean specific surface satisfying the foregoing equation (1) in a uniformly dispersed state.

As the wet-grinding machine, there can be used any of the commercially available wet-grinding machines such as the above mentioned Attritor, Dyno-Mill, and Sand Mill of horizontal type. Among these wet-grinding machines, Sand Mill and Dyno-Mill are desirably used since they excel in selectively grinding grit.

As the beads to be used in the wet-grinding machine, beads of about 3 mm or less in mean particle size are used. Specific examples of such beads are beads made of natural or synthetic mineral, beads comprising fine sand, beads made of hard glass, beads made of hard plastics, beads made of metal, etc.

Upon preparing the foregoing aqueous dispersion in the wet-grinding machine, a predetermined amount of beads is introduced into the wet-grinding machine. The beads are mechanically agitated together with the inorganic fluorescent pigment particles contained in the starting dispersion which is introduced thereinto while said dispersion is passing through or circulating within a treating vessel of the wet-grinding machine, thereby providing a desirable aqueous dispersion containing specific inorganic fluorescent pigment fine particles having a mean specific surface area satisfying the foregoing equation (1). During the wet-grinding process in the wet-grinding machine, whether or not the particles of the inorganic fluorescent pigment in the starting dispersion being ground are of said mean specific specific surface area is recognized by taking out the ground sample from the system and observing a mean specific surface area of the ground fine particles contained in the sample, using a commercially available powder surface area determinator with constant air pressure (produced by Shimadzu Seisakusho Ltd.).

As for the starting dispersion to be introduced into the wet-grinding machine in order to obtain a desirable aqueous dispersion containing the specific inorganic fluorescent pigment fine particles having a mean specific surface area satisfying the foregoing equation (1) in a uniformly dispersed state for the formation of the coating layer of the luminescent sheet for stamps according to the present invention, it is desired to use such a dispersion that contains particles of an inorganic fluorescent pigment in a solid content of 30 to 60% by weight in water, as the starting aqueous dispersion.

There is known a dry-grinding method for finely grinding solid particles. However, by the dry-grinding method, it is impossible to obtain the above aqueous dispersion for the formation of the coating layer of the luminescent sheet for stamps according to the present invention.

As the inorganic fluorescent pigment to be used in the present invention, there can be mentioned, for example, $Zn_2SiO_4$:Mn (which exhibits green color emission), $CaSiO_3$: Pb: Mn (which exhibits red color emission), ZnS: Cu (which exhibits green color emission), etc. Among these, inorganic fluorescent pigments which can be excited to exhibit emission with irradiation of light of 254 or 356 nm in wavelength are desirable.

The aqueous dispersion to be used for the formation of the coating layer of the luminescent sheet for stamps according to the present invention may contain one or more dispersants which are generally used for facilitating dispersion of a pigment in a coating composition for a coated paper, in case where necessary. As such dispersant, there can be mentioned, for example, sodium polyacrylate, sodium lignin sulfonate, phosphate, olefin maleic anhydride copolymer, sodium citrate, sodium succinate, etc. Further, it is possible to incorporate starch, PVA, etc. as a protective colloid into the aqueous dispersion.

Upon forming the coating layer of the luminescent sheet for stamps according to the present invention by using the aqueous dispersion prepared in the manner above described, there is provided a coating composition incorporated with the aqueous dispersion. The amount of the aqueous dispersion to be contained in the coating composition is an important factor to govern the characteristics of the resulting coating layer. In general, it is preferably in the range of from 0.5 to 4.0% by weight, more preferably in the range of from 1.0 to 3.0% by weight, respectively versus the total amount of the pigments constituting the coating composition. In the case where said amount is less than 0.5% by weight, the resulting sheet becomes such that it does not exhibit emission and thus, does not have a detectability required for the luminescent stamp. In the case where said amount exceeds 4.0% by weight, the coating composition becomes such that it is defective in coating suitability and the coating layer formed by such coating composition becomes such that it does not provide a sufficient abrasion resistance.

As the pigment other than the foregoing inorganic fluorescent pigment to be used in the present invention, there can be selectively used one or more kinds of the known pigments which are generally used for preparing coated papers. Specific examples of such pigments are clay, kaolin, aluminum hydroxide, calcium carbonate, titanium dioxide, barium sulfate, zinc oxide, satin white, calcium sulfate, talc, plastic pigments, etc.

Likewise, usable as the adhesive are, for example, proteins such as casein, soybean protein, synthetic proteins, etc.; conjugated diene polymer latexes such as styrene-butadiene copolymer, methacrylate-butadiene copolymer, etc.; acrylic polymer latexes such as polymers or copolymers of acrylic esters and/or methacrylic esters, etc.; vinyl polymer latexes such as ethylene-vinyl acetate copolymer, etc.; alkali soluble or alkali insoluble polymer latexes comprising said polymers which are modified by monomers containing functional groups such as carboxyl group; synthetic resin adhesives such as polyvinyl alcohol, olefin-maleic anhydride resin, melamine resin, etc.; starches such as cationized starch, oxidized starch, etc.; and cellulose derivatives such as carboxymethylcellulose, hydroxyethylcellulose, etc.

Further, the coating layer of the luminescent sheet for stamps according to the present invention may contain a variety of auxiliaries such as flow modifier, antifoaming agent, coloring dye, lubricant, water proof agent, retention agent, etc.

There is no particular limitation for the method of applying the foregoing coating composition containing the specific fluorescent pigment fine particles having a mean specific surface area satisfying the foregoing equation (1) onto the surface of a substrate for the formation of the coating layer of the luminescent sheet for stamps according to the present invention. In a preferred embodiment, a blade coating method is employed. In accordance with this coating method, a desirable coating layer having a uniform thickness and an evenly flat surface can be easily formed. Particularly, in order to form the coating layer by the blade coating method, a predetermined amount of the coating composition is applied onto the surface of the substrate by a coating blade to form a liquid coating comprising the coating composition on the surface of the substrate, followed by drying, to thereby form a layer to be the coating layer. The amount of coating is not specifically limited. It is usually 5 to 30 g/m$^2$, preferably 8 to 25 g/m$^2$ on the basis of dry weight.

As the substrate, there can be optionally used a wood free paper, mechanical paper, or an ordinary paper which is manufactured under acidic or alkaline conditions, or these papers applied with coating treatment to their surface.

The luminescent sheet for stamps according to the present invention provides various effects as above described. In addition to this, the luminescent sheet for stamps according to the present invention is distinguished from the known luminescent sheets that it is provided with the coating layer containing the specific inorganic fluorescent pigment fine particles with a mean specific surface area satisfying the foregoing equation (1) which is prepared through wet-grinding in a specific amount and because of this, it has an abrasion resistance of less than 1000 μg or specifically, less than 800 μg. Thus, the luminescent sheet for stamps according to the present invention can be smoothly and efficiently cut into pieces without damaging a cutting blade upon obtaining stamp products. By the way, in the case of cutting the luminescent sheet for stamps having an abrasion resistance exceeding 1000 μg, not only the cutting blade will be soon damaged to cause reduction in the cutting efficiency but also the resulting stamp products become such that they are defective in the apearance of this cut edges. This situation will be made more apparent by the later described examples.

Further, as above described, the luminescent sheet for stamps according to the present invention excels in printability. Particularly, when it is subjected to gravure printing, there are provided desirable and clear prints excelling in appearance thereon without causing scratches, missing dots, etc. which are often found in the case of the known luminescent sheet for stamps. This situation will be made more apparent by the later described examples.

In an alternative, the rear of the luminescent sheet for stamps according to the present invention may be provided with a layer comprising a water soluble paste such as dextrin, etc in case where necessary.

Further, it is possible for the luminescent sheet for stamps according to the present invention to be made in the form of a tack sheet for stamps which is provided with a release paper through an adhesive layer.

PREFERRED EMBODIMENT OF THE INVENTION

The advantages of the present invention are now described in more detail by reference to the following Examples and Comparative Examples, which are provided here for illustrative purposes only, and are not intended to limit the scope of the present invention.

Unless otherwise indicated, parts and % signify parts by weight and % by weight, respectively.

In the following Examples and Comparative Examples, there were evaluated: (i) stability of the aqueous dispersion containing inorganic fluorescent pigment fine particles which was prepared through wet-grinding treatment: (ii) degree of scratches appeared on the luminescent sheet obtained, upon gravure printing: (iii) printability (proportion of missing dots appeared) of the luminescent sheet obtained upon gravure printing: (iv) emission intensity of the luminescent sheet obtained: and (v) abrasion resistance of the luminescent sheet obtained.

Evaluation of each of the evaluation items (i) to (v) was performed in accordance with the following procedures.

Evaluation of the stability (i):

The aqueous dispersion containing inorganic fluorescent pigment fine particles obtained through wet-grinding treatment was allowed to stand for 24 hours, and the degree of agglomerates caused therein was observed visually.

The evaluated result is shown in the Table by the mark "" or "X", wherein the mark "" means the case where there was not caused any agglomerate, and the mark "X" means the case where agglomerates were caused.

Evaluation of the degree of scratches appearing (ii):

The luminescent sheet obtained was subjected to gravure printing, and there was observed the presence of scratches appearing at the printed surface of the sheet while irradiating the sheet with light of 254 nm in wavelength.

The evaluated result is shown in the Table by the mark "" "Δ" or "X", wherein the mark "" means the case where no scratch was found, the mark "Δ" means the case where scratches were slightly found, and the mark "X" means the case where scratches were evident.

Evaluation of the printability (proportion of missing dots appeared) of the luminescent sheet obtained (iii):

The luminescent sheet obtained was engaged in an inverted halftone gravure printing machine to be used for experimental purposes (produced by Kumagai-kiki Kogyo Kabushikikaisha) to provide the surface of the sheet with printed images. The sheet having the printed images was engaged in a missing dot analyzer (developed by Kanzaki Paper Manufacturing Co., Ltd.) to observe the proportion of missing dots per 6000 gravure printed dots.

The evaluated result is shown in the Table. As for the figure obtained, in the case where the figure is less than 10%, it is considered that the sheet is sufficient in printability. In the case where the figure exceeds 10%, it is considered that the sheet is insufficient in printability.

Evaluation of the emission intensity (iv):

This evaluation was carried out in the following manner Evaluation (1):

The luminescent sheet was irradiated with light of 254 nm in wavelength to examine the state of an emission generated as a result of light excitation at the surface of the sheet visually. The evaluated result is shown in the Table by the mark "" or "X", wherein the mark "" means the case where the initial emission was of a desirably high intensity and it was maintained without the intensity being reduced, and the mark "X" means the case where the intensity of the initial emission was of a undesirably low intensity and the intensity was gradually reduced.

Evaluation (2):

After the luminescent sheet was allowed to stand at 40° C. and 90% RH for 24 hours, followed by drying in the air, it was irradiated with light of 254 nm in wavelength to examine the state of an emission generated as a result of light excitation at the surface of the sheet visually. The evaluated result was compared with the evaluated result obtained in the Evaluation (1). The compared result obtained is shown in the Table by the mark "", "Δ" or "X", wherein the mark "" means the case where no difference was found, the mark "Δ" means the case where a slight reduction was found, and the mark "X" means the case where an apparent reduction was found.

Evaluation of the abrasion resistance (v):

In this evaluation, there was firstly provided an assembly comprising 10 of the luminescent sheets obtained being superposed. For this assembly, there were made 10000 different holes repeatedly by a needle made of a brass composed of Cu/Zn-52/48 under a predetermined condition. There was observed a difference between the weight of the needle prior to use and the weight of the needle after being used. The value (unit: μg) obtained as the difference was designated as the abrasion resistance, and it is shown in the Table.

EXAMPLE 1

An aqueous dispersion cotaining 0.2 parts of sodium polyacrylate as a dispersant was added with 100 parts of particles of $Zn_2SiO_4$: Mn (inorganic fluorescent pigment) in an amount to make the resulting dispersion to be of a solid content of 40%. The resultant was introduced into a turbine blade type agitator, wherein it was agitated to thereby obtain a dispersion. The mean specific surface area ($Sw_2$) of the inorganic fluorescent pigment particles contained in the dispersion was 8000 $cm^2/g$. The dispersion was then introduced into a Sand Grinder, wherein it was treated at a rotating speed of 800 rpm and at a flow rate of 200 l/H, to thereby obtain a wet-ground aqueous dispersion. The mean specific surface area ($Sw_1$) of the inorganic fluorescent pigment fine particles contained in this dispersion was 10000 $cm^2/g$. Thus, the ratio of $Sw_1/Sw_2$ for this dispersion was found to be 1.25.

5 Parts of the dispersion thus obtained was introduced into a composition composed of 20 parts of kaolin, 80 parts of ground calcium carbonate, 2 parts of oxidized starch (solid content), 14 parts of styrene-butadiene copolymer latex (solid content), and water in a predetermined amount, to thereby obtain a coating composition of 58% in solid content.

The coating composition thus obtained was applied onto the surface of a wood free paper of 64 $g/m^2$, in an amount to be 20 $g/m^2$ when dried, by a blade coater to form a liquid layer on said paper, which was followed by drying, to thereby obtain a coated sheet. The moisture content of the sheet was 6%. This sheet was then subjected to supercalendering, wherein dextrin was applied onto its rear surface in an amount to be 15 $g/m^2$ (solid content) when dried, to thereby provide said rear surface with a layer composed of dextrin.

Thus, there was obtained a luminescent sheet for stamps. The sheet thus obtained was evaluated with respect to each of the foregoing evaluation items (i) to (v) in accordance with the foregoing corresponding evaluation manner. The evaluated results are collectively shown in the Table.

EXAMPLE 2

The procedures of Example 1 were repeated, except that as the inorganic fluorescent pigment, there was used $CaSiO_3$: Pb: Mn, to thereby obtained a luminescent sheet for stamps. The resultant sheet was evaluated in the same way as in Example 1. The evaluated results are collectively shown in the Table.

In the above, the value of $Sw_2$ was 9000 $cm^2/g$, and the value of $Sw_1$ was 10500 $cm^2/g$. The ratio of $Sw_1/Sw_2$ was 1.17.

EXAMPLE 3

The procedures of Example 1 were repeated, except that as the inorganic fluorescent pigment, there was used ZnS: Cu, to thereby obtain a luminescent sheet for stamps. The resultant sheet was evaluated in the same way as in Example 1. The evaluated results are collectively shown in Table.

In the above, the value of $Sw_2$ was 9000 $cm^2/g$, and the value of $Sw_1$ was 12500 $cm^2/g$. The ratio of $Sw_1/Sw_2$ was 1.39.

COMPARATIVE EXAMPLE 1

The procedures of Example 1 were repeated, except that wet-grinding treatment was not conducted for the dispersion, to thereby obtain a comparative luminescent sheet for stamps. The resultant sheet was evaluated in the same way as in Example 1. The evaluated results are collectively shown in the Table.

COMPARATIVE EXAMPLE 2

The procedures of Example 1 were repeated, except that the conditions at the time of conducting the wet-grinding treatment by the Sand Grinder for the dispersion were changed to 200 rpm for the rotating speed and 800 l/H for the flow rate, to thereby obtain a comparative luminescent sheet for stamps. The resultant sheet was evaluated in the same way as in Example 1. The evaluated results are collectively shown in the Table.

In the above, the value of $Sw_2$ was 8000 $cm^2/g$, and the value of $Sw_1$ was 8100 $cm^2/g$. The ratio of $Sw_1/Sw_2$ was 1.01.

COMPARATIVE EXAMPLE 3

The procedures of Example 1 were repeated, except that the dispersion was treated in the Sand Grinder at a rotating speed of 200 rpm and at a flow rate of 800 l/H while circulating the dispersion, to thereby obtain a comparative luminescent sheet for stamps. The resultant sheet was evaluated in the same way as in Example 1. The evaluated results are collectively shown in the Table.

In the above, the value of $Sw_2$ was 8000 $cm^2/g$, and the value of $Sw_1$ was 20000 $cm^2/g$. The ratio of $Sw_1/Sw_2$ was 2.5.

COMPARATIVE EXAMPLE 4

The procedures of Example 1 were repeated, except that the amount of the wet-ground aqueous dispersion to be added was changed to 0.5 parts, to thereby obtain a comparative luminescent sheet for stamps. The resultant sheet was evaluated in the same way as in Example 1. The evaluated results are collectively shown in the Table.

COMPARATIVE EXAMPLE 5

The procedures of Example 1 were repeated, except that the amount of the wet-ground aqueous dispersion to be added was changed to 12 parts, to thereby obtain a comparative luminescent sheet for stamps. The resultant sheet was evaluated in the same way as in Example 1. The evaluated results are collectively shown in the Table.

The results shown in Table indicate that any of the luminescent sheets for stamps obtained in Examples 1 to 3, which are provided with a coating layer containing specific inorganic fluorescent pigment fine particles having a mean specific surface area which satisfies the foregoing equation (1), is satisfactory with respect to any of the evaluation items (i) to (v) required for a luminescent sheet for stamps to be desirable.

TABLE

| | the stability of the aqueous dispersion (i) | the degree of scratches (ii) | the printability (proportion of missing dots appeared) (iii) | emission intensity of the luminescent sheet (iv) (1) | emission intensity of the luminescent sheet (iv) (2) | abrasion resistance of the luminescent sheet (v) |
|---|---|---|---|---|---|---|
| Example 1 | ○ | ○ | 7.0 | ○ | ○ | 800 |
| Example 2 | ○ | ○ | 6.4 | ○ | ○ | 750 |
| Example 3 | ○ | ○ | 5.2 | ○ | ○ | 720 |
| Comparative Example 1 | x | x | 15.0 | ○ | x | 1500 |
| Comparative Example 2 | x | x | 13.0 | ○ | Δ | 1200 |
| Comparative Example 3 | ○ | ○ | 5.5 | x | ○ | 700 |
| Comparative Example 4 | ○ | ○ | 7.2 | x | ○ | 900 |
| Comparative Example 5 | ○ | Δ | 6.8 | ○ | ○ | 1300 |

What we claim is:

1. A method for the production of a luminescent sheet for stamps said sheet capable of being printed with a printing ink by gravure printing and to provide individual stamps which can be distinguished in a mail distinguishing system when said stamps are used on mail, said luminescent sheet comprising a substrate and a luminescent coating layer formed on the surface of said substrate, said method comprising (i) subjecting an aqueous dispersion (A) containing particles (a) of an inorganic fluorescent pigment having a mean specific surface area of $Sw_2$ to wet-grinding using a wet-grinding machine, whereby said particles (a) of said aqueous dispersion (A) are finely ground to a mean specific surface area of $Sw_1$, thereby obtaining an aqueous dispersion (B) containing fine particles (b) of said inorganic fluorescent pigment having a mean specific surface area $Sw_1$, the said particles (b) satisfying the equation $2.0 \geqq Sw_1/Sw_2 \geqq 1.05$, (ii) incorporating said aqueous dispersion (B) in an amount sufficient to provide an abrasion resistance of less than 1000 μg to the resulting luminescent coating layer into a coating composition (C) containing at least one pigment other than said fluorescent pigment to obtain a coating composition for the formation of said luminescent coating layer, (iii) applying said coating composition obtained in step (ii) onto the surface of a substrate to form a liquid coating thereon, and (iv) drying said liquid coating formed on said substrate.

2. A method according to claim 1, wherein said wet-grinding machine is a sand mill.

3. A method according to claim 1, wherein the amount of the fine particles (b) contained in the coating composition obtained in step (ii) for the formation of the luminescent layer is in the range of from 0.5 to 4.0% by weight of the total amount of the pigments contained in said coating composition.

4. A method according to claim 3, wherein the amount of the fine particles (b) is in the range of from 1.0 to 3.0% by weight of the total amount of the pigments contained in said coating composition.

5. A method according to claim 1, wherein the inorganic fluorescent pigment is a member selected from the group consisting of $Zn_2SiO_4$:Mn, $CaSiO_3$:Pb:Mn and ZnS:Cu.

6. A method according to claim 1, wherein the aqueous dispersion (A) contains at least one dispersant selected from the group consisting of sodium polyacrylate, sodium lignin sulfonate, phosphate, olefin maleic anhydride copolymer, sodium citrate and sodium succinate.

7. A method according to claim 1, wherein the aqueous dispersion (A) contains a protective colloid selected from the group consisting of starch and polyvinyl alcohol.

8. A method according to claim 1, wherein the aqueous dispersion (A) contains at least one dispersant selected from the group consisting of sodium polyacrylate, sodium lignin sulfonate, phosphate, olefin maleic anhydride copolymer, sodium citrate and sodium succinate and a protective colloid selected from the group consisting of starch and polyvinyl alcohol.

9. A method according to claim 1, wherein said at least one pigment contained in the coating composition (C) is selected from the group consisting of clay, kaolin, aluminum hydride, calcium carbonate, titanium dioxide, barium sulfate, zinc oxide, satin white, calcium sulfate, talc and plastic pigments.

10. A method according to claim 1, wherein the substrate is a member selected from the group consisting of wood free paper, mechanical paper, ordinary paper which is manufactured under acidic or alkaline conditions and these papers applied with coating treatment to their surface.

* * * * *